United States Patent [19]

Wolff et al.

[11] 4,019,090

[45] Apr. 19, 1977

[54] SELF-STEPPING VERTICAL SCAN SYSTEM

[75] Inventors: David Allen Wolff, Schaumburg; Walter Kowalski, Franklin Park, both of Ill.

[73] Assignee: Motorola, Inc., Schaumburg, Ill.

[22] Filed: Dec. 5, 1975

[21] Appl. No.: 638,123

[52] U.S. Cl. ..... 315/8.5; 315/365; 315/391; 340/324 AD

[51] Int. Cl.[2] ..... H01J 29/70

[58] Field of Search ..... 315/8.5, 365, 391, 393; 340/324 A, 324 AD, 366 CA

[56] References Cited

UNITED STATES PATENTS 3,816,791 6/1974 Fluegel ..... 340/324 AD X

*Primary Examiner*—Eugene R. La Roche
*Attorney, Agent, or Firm*—Margaret Marsh Parker; James W. Gillman

[57] ABSTRACT

Circuitry utilizing either composite sync or separated sync data provides self-stepping capability for the vertical scan of a CRT alphanumeric display. A counter counts horizontal sync pulses for varying the vertical scan rate between rows of characters in steps, and is synchronized with the beginning of each frame by the vertical sync pulse. Alphanumeric data can be displayed with any desired spacing between rows without change of character format and with minimum effect on the size of the displayed characters.

10 Claims, 7 Drawing Figures

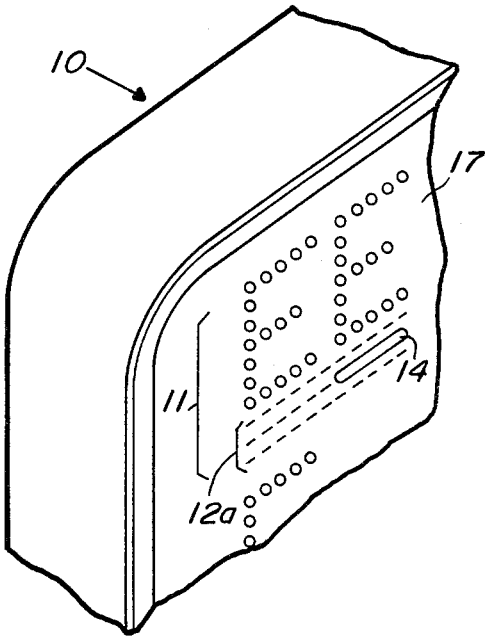
Fig. 1
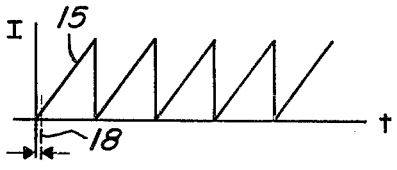
Fig. 4
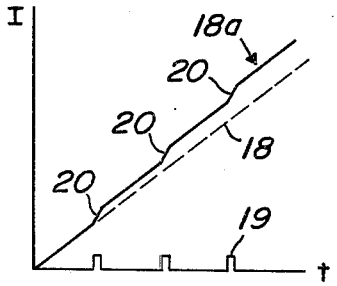
Fig. 5
Fig. 2
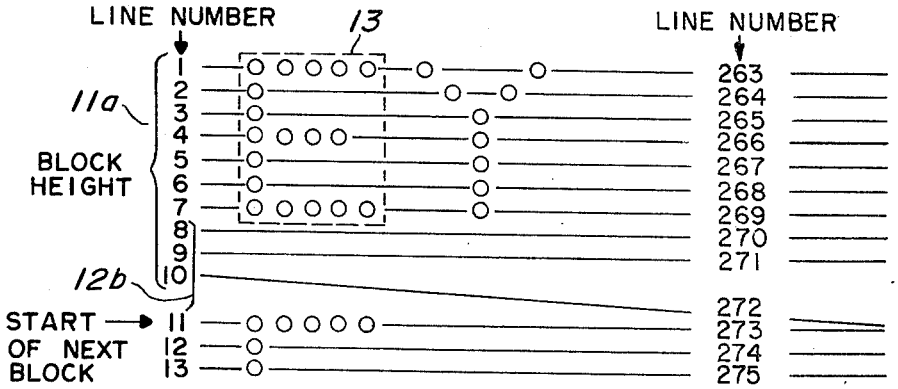
Fig. 3
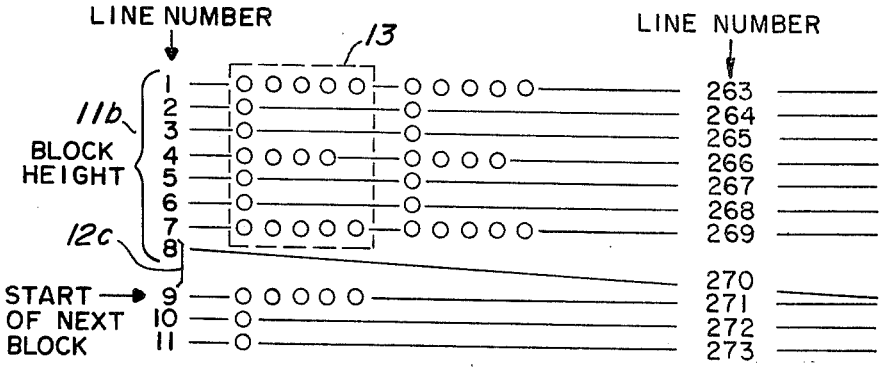

SELF-STEPPING VERTICAL SCAN SYSTEM

BACKGROUND OF THE INVENTION

This invention relates to the field of visual display (CRT) devices and more particularly to an improved circuit arrangement for spacing the data rows on a display screen.

There are many applications for alphanumeric displays, including airline terminal monitors and computer data displays. A typical format might be a five-by-seven array of dots to form the characters, utilizing seven horizontal lines (no interlace) with three lines for spacing between rows of characters. Added clarity can be gained by simply using more horizontal lines for spacing, but this obviously reduces the maximum number of rows of data that can be displayed concurrently if the standard horizontal line rate is used. Likewise, more data could be displayed with reduced clarity by using fewer lines for spacing. One compromise solution is to use interlaced scan as in broadcast television, but the resulting 30 Hz flicker caused by the displaced fields requires the use of phosphors with longer persistence. Such phosphors, however, have poorer spot definition and are subject to "burn" or permanent darkening of the phosphor. Interlaced scan may also require that lines of characters begin on odd and even lines alternately in order to minimize field-to-field variation. Another approach is to lower the vertical scan rate from 60 Hz to 50 Hz, but this requires great care in shielding 60 Hz interference from the CRT device. Increasing the number of horizontal lines is still another possibility but, because both dot and character rates are increased proportionately, this solution is limited by the "roll-off" of the cable. A better solution is to "step" the vertical scan by providing a pulse to it during one of the horizontal lines between each two rows of characters.

The latter has been accomplished in the prior art by running a separate line to the display device and sending a stepping pulse when extra spacing was desired since the extra pulse cannot easily be combined with and separated from the video signal. As the display device may be a monitor in an airport or other remote location, it would be advantageous to eliminate the need for this extra cable.

SUMMARY OF THE INVENTION

It is, therefore, an object of the present invention to provide for a CRT display device an improved arrangement for spacing the rows of alphanumeric characters.

It is a particular object to provide this capability without requiring less desirable phosphors, more shielding, or an additional cable to each monitor.

The above objectives are accomplished in the present invention by adding simple circuitry to the monitor unit itself which will produce an appropriate pulse for stepping the vertical at the appropriate horizontal lines. This produces extra spacing between rows of data relative to the size of the data. If desired, the vertical dimension can then be reduced by the amount required to fit all raster lines onto the screen.

The system does not require sending an additional signal out to the monitor, which would require an additional cable in order to avoid the complicated and troublesome process of combining and separating the additional signal and the video signal. The system utilizes the standard horizontal and vertical sync signals of the video signal and can use either the composite or already separated signals. When using the composite sync signal, separating means is provided in the stepping section of the monitor circuitry. The horizontal sync pulses are counted in a counter circuit until a predetermined number is reached. This number is programmable but would be at least one more than the number of horizontal lines forming one character. When the predetermined number is reached, a pulse is generated, shaped, and sent to the vertical sweep circuit. There the pulse causes a step in the vertical sweep saw tooth. The step pattern is repeated down the raster, then the vertical sync pulse stops the counter during the vertical sync period and restarts the counter at an identical time for each raster. Since interlace is not normally used with data presentation due to the annoyance of 30 Hz flicker with a small bright spot on a dark background, interlace does not cause a problem in using the vertical pulse to reset the counter.

BRIEF DESCRIPTION OF THE DRAWING

FIG. 1 shows a portion of a CRT alphanumeric display device and the normal character format.

FIG. 2 shows the change in data presentation when the present invention is used.

FIG. 3 shows an alternative data presentation.

FIG. 4 shows the usual vertical sweep current waveform.

FIG. 5 shows a small portion of the waveform of FIG. 4 with the vertical "steps" of the present invention added.

DETAILED DESCRIPTION OF A PREFERRED EMBODIMENT

Figure 7:
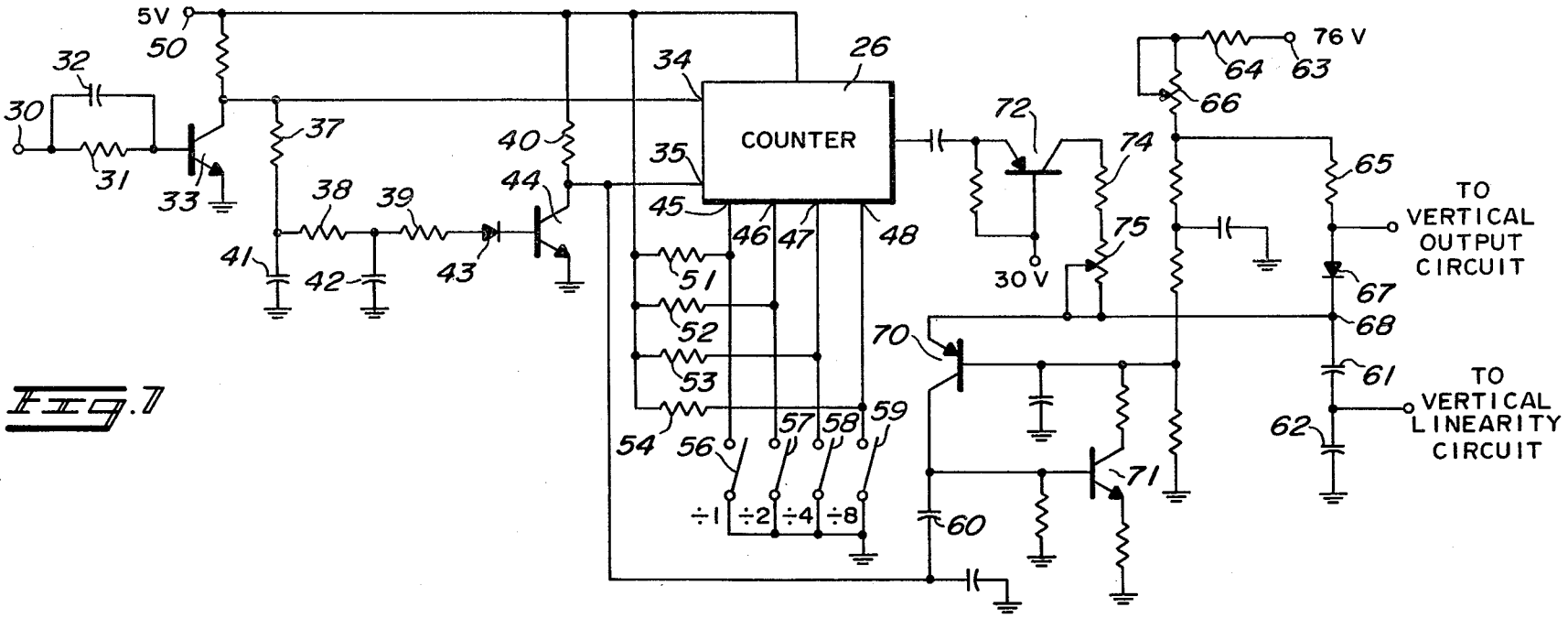
FIG. 7 is a schematic diagram of a portion of a CRT display device incorporating the present invention.

The present invention will be best understood with reference to the drawing wherein FIG. 1 illustrates a common format for an alphanumeric display on a CRT device 10 (partially shown). Each 10 horizontal lines constitute a block 11, seven lines of which are used to form characters and three lines of which provide a space 12*a* between rows (shown dotted in on FIG. 1). Each character is formed from an array 13 (FIG. 2) of dots, seven high and five wide, as exemplified by the letters E of FIGS. 1 and 2. In practice a cursor 14 marks the location of the next character (or space) to be entered. There is normally no interlace, and the dots in the second field are superimposed on those of the first field. As shown in FIG. 2, block 11*a* the first row of data plus spacing 12*b*, uses horizontal lines 1–10, being reinforced on the next field by lines 263–272. Interlace may, however, be used when there is an urgent need to display more rows of data than are available without interlace. For example, with interlace, the first row of data might use lines 0, 263, 1, 264, 2, 265, and 3 for the characters and lines 266, 4, 267, 5, 268 for the spacing. Interlaced data is not illustrated since it requires no change in the circuit of the invention other than programming. The present invention, it should be noted, is not limited to any particular character format.

In FIG. 2, the space 12*b* is B 12*a* after it has been expanded by "stepping" the vertical sweep current at line 10. This stepping is repeated at each tenth line which gives better separation, but lengthens the raster accordingly. In order to avoid losing some data presentation capability, the vertical size control could be adjusted to reduce the overall vertical dimension of the raster. This would reduce the size of the alphanumeric characters slightly, but the change would be negligible in view of the gain in legibility when the space between rows of characters is increased relative to character height.

FIG. 3 is an alternative application of the invention which uses only eight lines per block 11*b*. The spacing 12*c* consists of only line eight, stepped to provide the same separation as in FIG. 1, but now six more rows of data per raster can be accommodated. (240 lines ÷ 10 lines per row = 24 rows, 240 lines ÷ 8 lines per row = 30 rows.) Again, the raster height would be reduced to obtain the maximum advantage of the change.

FIG. 4 shows the usual sawtooth current waveform 15 of a vertical sweep circuit 16 (FIG. 6) of the CRT device 10. As is well known in the art, as the current increases in the horizontal and vertical deflection circuits, the CRT beam is pulled across the screen 17 (FIG. 1) from side to side and top to bottom, and in the customary application both sweeps are linear.

In FIG. 5 a greatly enlarged view of a very small portion 18*a* of the sawtooth 15 of FIG. 4 is shown after stepping pulses 19 have been added, producing steps 20 in the vertical sweep current. With the stepped current waveform 18*a* of FIG. 5 applied to the vertical sweep, the normal linear sweep of the CRT beam from top to bottom of the screen is stepped at predetermined intervals and between the rows of alphanumeric characters to provide increased spacing such as that shown at line 10 of FIG. 2. The original, unstepped waveform 18 is indicated by a dotted line on FIG. 5 for reference. FIGS. 4 and 5 are not drawn to any scale, and no scale should be inferred therefrom.

Figure 6:
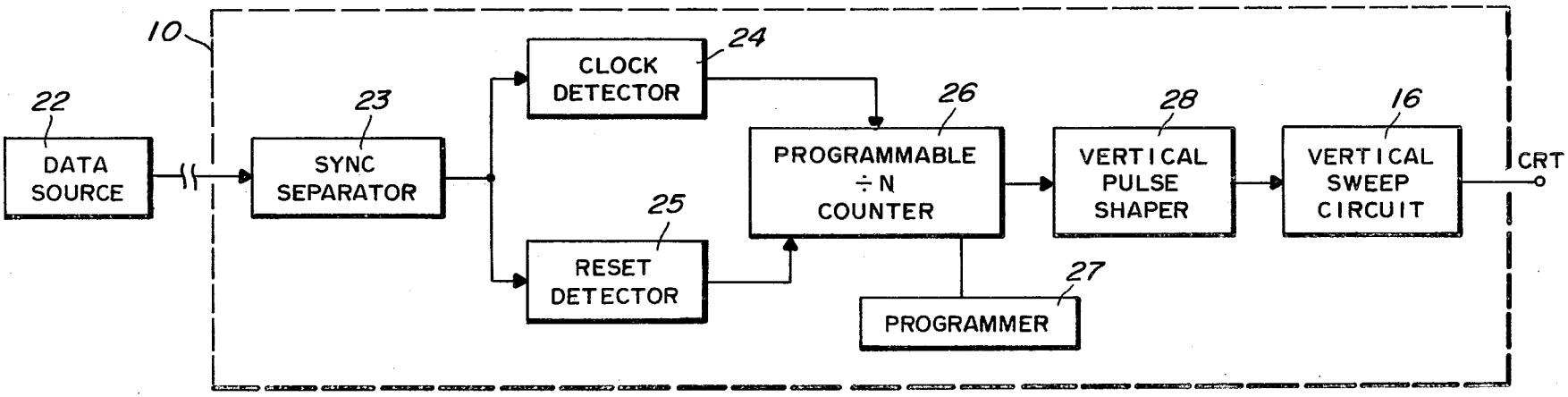
FIG. 6 is a block diagram of a portion of a CRT display device utilizing the present invention.

FIG. 6 is a block diagram of a portion of a CRT display device which is constructed in accordance with the present invention. A data source 22 supplies the complete video signal (normally by cable) to the monitor 10 (partially shown), wherein the composite sync signal is separated from the data information in a sync separator 23 as is known in the art. The composite sync signal is then coupled to both a clock detector 24 and a reset detector 25. The outputs of the detectors 24, 25 are coupled to separate inputs of a divide-by-*n* counter 26 which can be programmed by a programmer 27 to count a set number of horizontal sync pulses. The clock detector 24 and reset detector 25 may be either the horizontal and vertical sync detectors of the monitor itself or separate detectors in the stepping portion of the circuit. Upon reaching the programmed number, the counter 26 will produce a pulse which is coupled to the vertical pulse shaping circuit 28, the output of which is coupled to the vertical sweep output circuit 16 of the CRT device 10. After each output pulse, the counter 26 is reset and the counting sequence is repeated. When the vertical sync pulse signal is received, the counter is reset to a zero count and held there through the vertical sync pulse. Thus, each expanded line of the data display occurs on the same horizontal line of each field.

The circuit diagram of FIG. 7 shows a preferred embodiment of the invention utilizing composite sync at an input terminal 30. A resistor 31 and a capacitor 32 comprise a peaking circuit at the input to a transistor 33. From the collector of the transistor 33, the composite sync signal is coupled to a first input 34 of the counter 26, wherein the horizontal sync pulses are counted.

The composite signal is also coupled through a double integrating network which provides the separated vertical sync pulse to a second input 35 of the counter 26. The network comprises four resistors 37, 38, 39, and 40, two capacitors 41, 42, a diode 43, and a transistor 44. The vertical sync pulses at counter input terminal 35 reset the counter to zero and hold the count at zero until the end of the vertical sync pulse so that the counter begins at the same horizontal line on each raster.

The counter 26 is, in this preferred embodiment, a Motorola MC4018 or an equivalent divide-by-*n* counter, and has at least four programming inputs 45, 46, 47 and 48. Each of the programming inputs is coupled to a voltage supply 50 by resistors 51, 52, 53 and 54, respectively, and to ground through switches 56, 57, 58 and 59, respectively. The vertical sync pulses at the collector of transistor 44 are also coupled through a capacitor 60 to a vertical oscillator comprising two capacitors 61, 62 which are gradually charged by a voltage supply 63 through two fixed resistors 64, 65, a variable resistor 66, a diode 67, and a connection point 68. The variable resistor 66 controls the vertical dimension of the displayed raster. The capacitors are discharged quickly by two transistors 70, 71, thus producing the required sawtooth waveform 15 as shown in FIG. 4. Meanwhile the output of the counter 26, which is of the form of the stepping pulses 19 of FIG. 5, is coupled to a driver stage which includes a transistor 72. The output of the transistor 72 is coupled to the connection point 68 through a fixed resistor 74 and a variable resistor 75. The variable resistor controls the current of the stepping pulses 19.

When the stepping pulses are added at point 68 to the steady charging current from the supply 63, the charge on the capacitors 61, 62 increases as shown in waveform 18*a*. This waveform 18*a* is then coupled to the vertical sweep circuit 16 which includes driver and output stages and the vertical deflection yoke. Thus, when data in the form of a standard video signal or similar signal is transmitted by any means to a CRT display device, it can be displayed as transmitted (and illustrated in FIG. 1). It can also, by proper programming of the counter 26, have the rows of alphanumeric data separated by additional space between rows for increased clarity. As illustrated in the example of FIG. 2, the array 13 utilizes seven horizontal lines and the spacing, three lines. For the expanded spacing, the program switches 57 and 59 are closed, providing "divide by 10" capability, and every tenth line is expanded vertically to occupy the vertical space of several lines. For the example of FIG. 3, only program switch 59 would be closed, providing "divide by 8" capability, and every eighth line would be expanded vertically.

Thus, there has been provided in accordance with the invention circuitry that fully satisifies the object, aims and advantages set forth above. While the invention has been described in conjunction with specific embodiments thereof, it is evident that many alternatives and variations will be apparent to those skilled in the art in light of the foregoing description. Accordingly, it is intended to embrace all such alternatives and variations as fall within the spirit and scope of the appended claims.

What is claimed is:

1. In a CRT display device having horizontal and vertical sweep circuits for providing a raster and using both horizontal and vertical synchronizing pulses, a self-stepping circuit arrangement for the vertical sweep circuit comprising:

programmable counter means for counting the horizontal sync pulses and for providing an output pulse when a predetermined, set count is reached;

means for coupling the vertical synchronizing pulses to the counter means for resetting and restarting the counter means at the same time relative to each raster;

pulse shaping means for receiving output pulses from the counter means and providing stepped vertical sweep signals to the vertical sweep output circuit; and means for controlling the pulse shaping means for adjusting the raster height.

2. A self-stepping circuit arrangement according to claim 1 wherein the counter means comprises a divide-by-*n* counter and further includes manually adjustable programming means for changing the predetermined count.

3. A self-stepping circuit arrangement according to claim 1 and further including separating means for providing separate horizontal and vertical sync pulses from a composite sync signal, the outputs of the separating means being coupled to the counter means.

4. A self-stepping circuit arrangement according to claim 1 wherein the counter means, resetting means, restarting means and pulse shaping means are positioned at the CRT display device location.

5. A self-stepping circuit arrangement according to claim 1 wherein the pulse shaping means comprises circuit means for providing a current having a sawtooth waveform and adder means for combining the output pulses from the counter means with the sawtooth current.

6. A self-stepping circuit arrangement according to claim 5 wherein the pulse shaping means includes means for manually adjusting the width of the output pulse provided by the programmable counter means prior to combining the output pulse of the counter means with the sawtooth current.

7. A self-stepping circuit arrangement according to claim 5 wherein the circuit means for providing a sawtooth current comprises voltage supply means, capacitor means, means coupled to the voltage supply means for providing a constant charging current to the capacitor means, and means for discharging the capacitor means.

8. A self-stepping circuit arrangement according to claim 7 wherein the discharge means comprises transistor means.

9. A self-stepping circuit arrangement according to claim 7 wherein the discharge means is coupled to the vertical sync pulse for synchronizing the capacitor discharge.

10. In a CRT display device a method of providing increased legibility of display data, comprising the steps of:

receiving a composite video signal;

separating from the composite signal the horizontal sync pulses;

programming a digital counter to a predetermined number for providing an output signal in response thereto;

coupling said horizontal sync pulses to the digital counter;

separating from the composite signal the vertical sync pulses;

coupling the vertical sync pulses to the input reset terminal of the digital counter;

coupling the vertical sync pulses to a charge storing circuit in the vertical sweep circuit of the CRT device and increasing the output of the sweep circuit by steps;

reducing the voltage supply of the vertical sweep circuit by an amount sufficient to substantially compensate for the increased vertical travel of the electron beam of the CRT device due to the added steps.

* * * * *